US006791442B1

(12) United States Patent
Schmidt

(10) Patent No.: US 6,791,442 B1
(45) Date of Patent: Sep. 14, 2004

(54) MAGNETIC LATCHING SOLENOID

(75) Inventor: Stephen M. Schmidt, Menomonee Falls, WI (US)

(73) Assignee: Trombetta, LLC, Menomonee Falls, WI (US)

( * ) Notice: Subject to any disclaimer, the term of this patent is extended or adjusted under 35 U.S.C. 154(b) by 0 days.

(21) Appl. No.: 10/719,351

(22) Filed: Nov. 21, 2003

(51) Int. Cl.[7] ..... H01F 7/08
(52) U.S. Cl. ..... 335/220; 335/266
(58) Field of Search ..... 335/220–229, 335/266–268; 251/129

(56) References Cited

U.S. PATENT DOCUMENTS

| | | | |
|---|---|---|---|
| 1,269,564 | A | 6/1918 | Henderson and Stevens |
| 1,361,935 | A | 12/1920 | Villiers |
| 1,668,752 | A | 5/1928 | Anderson |
| 1,857,349 | A | 5/1932 | Boehm |
| 2,444,118 | A | 6/1948 | Snyder |
| 2,560,444 | A | 7/1951 | Jackson et al. |
| 2,708,245 | A | 5/1955 | Werner |
| 2,915,681 | A | 12/1959 | Troy |

(List continued on next page.)

FOREIGN PATENT DOCUMENTS

| | | |
|---|---|---|
| EP | 0 721 650 B1 | 1/1999 |
| GB | 2 112 212 A | 7/1982 |
| GB | 2 289 374 A | 11/1995 |
| WO | WO 82/03944 | 11/1982 |
| WO | WO 95/07542 | 3/1995 |

OTHER PUBLICATIONS

Article: "MV Vacuum Switchgear based on Magnetic Actuators", Trends in Distribution Switchgear, Nov., 1998, pp. 85–90.
Web page: Brian McKean Associates, Aug. 28, 2000, 6 pages.
Article: "Fast–Acting Long–Stroke Bistable Solenoids with Moving, Permanent Magnets", Transactions on Industry Applications, vol. 26, No. 3, May/Jun. 1990, pp. 401–406 plus 2 pages.
Article: "Magnets & Vacuum—The Perfect Match", Trends in Distribution Switchgear, Nov. 1998, pp. 73–79.
Article: "Computer Aided Optimal Design of Magnetic Actuator for Autoreclosure Application", Authors; Renforth, Auckland Varlow, pp. 80–85, date unknown, (No date).

*Primary Examiner*—Lincoln Donovan
*Assistant Examiner*—Bernard Rojas
(74) *Attorney, Agent, or Firm*—Ryan Kromholz & Manion, S.C.

(57) ABSTRACT

A magnetic latching solenoid including a solenoid operating mechanism, and further comprising a magnetic latching subassembly cooperating with, but positioned independently of the solenoid operating mechanism. In a preferred embodiment, the solenoid operating system may be of a bi-directionally operated structure arranged for alternative magnetically latching function. Independently operated, magnetic latching subassemblies are spaced apart from one another and from opposite ends of the bi-directionally operated solenoid operating mechanism.

11 Claims, 4 Drawing Sheets

U.S. PATENT DOCUMENTS 3,070,730 A * 12/1962 Gray et al. ..... 335/229
3,103,603 A 9/1963 Reutter
3,473,898 A 10/1969 Maxfield
3,486,352 A 12/1969 Bouthors et al.
3,683,239 A 8/1972 Sturman
3,743,898 A 7/1973 Sturman
3,747,379 A 7/1973 Cabanes
3,755,766 A 8/1973 Read, Jr.
3,792,390 A 2/1974 Boyd
3,828,288 A 8/1974 Boyd
4,004,258 A 1/1977 Arnold
4,046,244 A * 9/1977 Velazquez ..... 400/124.17
4,072,918 A 2/1978 Read, Jr.
4,127,835 A 11/1978 Knutson
4,144,514 A * 3/1979 Rinde et al. ..... 335/229
4,218,669 A 8/1980 Hitchcock et al.
4,253,493 A 3/1981 English
4,285,603 A 8/1981 Bernardis et al.
4,306,207 A 12/1981 Tada et al.
4,315,197 A 2/1982 Studer
4,383,234 A * 5/1983 Yatsushiro et al. ..... 335/253
4,419,643 A 12/1983 Ojima et al.
4,463,332 A 7/1984 Everett
4,509,026 A 4/1985 Matsushita
4,621,660 A 11/1986 Klocke
4,635,016 A 1/1987 Guery et al.
4,660,011 A 4/1987 Reiter
4,683,452 A 7/1987 Henley
4,779,582 A 10/1988 Lequesne
5,032,812 A 7/1991 Banick et al.
5,268,662 A * 12/1993 Uetsuhara et al. ..... 335/229
5,470,043 A 11/1995 Marts et al.
5,497,135 A 3/1996 Wisskirchen et al.
5,598,625 A 2/1997 Bluen et al.
5,734,310 A 3/1998 Ankney et al.
5,804,962 A 9/1998 Kather et al.
5,912,604 A 6/1999 Harvey et al.
6,009,615 A 1/2000 McKean et al.
6,179,268 B1 * 1/2001 Seid ..... 251/65
6,182,942 B1 * 2/2001 Kadlicko ..... 251/129.1
6,229,421 B1 * 5/2001 Floyd et al. ..... 335/253
6,246,131 B1 6/2001 Sheng

* cited by examiner

MAGNETIC LATCHING SOLENOID

FIELD OF THE INVENTION

The present invention relates to a solenoid construction, and in particular, to a magnetic latching solenoid.

BACKGROUND OF THE INVENTION

Magnetically latched solenoid structures are well-known in the art, and have utilized various permanent magnet materials for latching purposes, i.e. wherein a magnet acts to retain an independently operable solenoid plunger adapted for linear motion of a plunger operated push and/or pull actuating rod for motivating electrical switchgear towards open and/or closed circuit position. Prior art devices have shown placement of a permanent magnet circuit inside the solenoid's magnetic circuit, and energizing the solenoid coil to cancel out the field of the permanent magnet, or to over power the magnetic field to affect motion. This materially affects the action of the operating components towards movement and latching activity.

SUMMARY OF THE INVENTION

It is an object of the present invention to provide a magnetic latching solenoid design, which improves upon the prior art by locating the latching permanent magnet(s) assemblies externally of the solenoid operating mechanism. This novel design approach outperforms the prior art in actuation speed and magnetic efficiency. The basic design concept is preferably used in connection with bi-directional operated latching solenoids. Certain aspects of the magnetic latching concept disclosed herein have application in both single and dual directional solenoid structures.

It is another object of the invention to provide a magnetically, operated actuator device, utilizing a permanent magnet latching assembly incorporating high-energy, permanent magnets of rare earth or other relatively fragile permanent magnet materials, and to provide a mechanical structure that protects such materials from damaging impact when subjected to motion of a solenoid plunger. The present concept may also use ceramic or Alnico magnets where their magnetic parameters permit.

Further, it is an object of the invention to provide a common pole piece in the center of the solenoid assembly. This allows the two axially spaced solenoid portions to operate magnetically independently, unlike conventional dual action solenoids, which suffer from magnetic leakage around opposite ends of the unit. Further, the present concept provides for the oppositely disposed latching members to operate independently from one another and from their respective solenoid construction.

Still another object of the invention is to meet industry requirements for circuit breakers controlled by the present dual-action solenoid, which is: Trip-Close-Trip, all taking place on stored energy. The disclosed design can accomplish this function at a low energy level, thus increasing storage cost efficiency.

It will be apparent upon reading the following description of the preferred embodiment that the invention provides, in its bi-directional mode, three movable structures assembled in one housing, one of which structures has linkage to the work load. The magnetic latching structures are magnetically independent of the solenoid structures, and each of the solenoids are magnetically independent of the other solenoid.

BRIEF DESCRIPTION OF THE DRAWINGS

Further objects and advantages of this invention will become apparent from the following description taken in conjunction with the accompanied drawings in which.

DESCRIPTION OF THE PREFERRED EMBODIMENT

Figure 1:
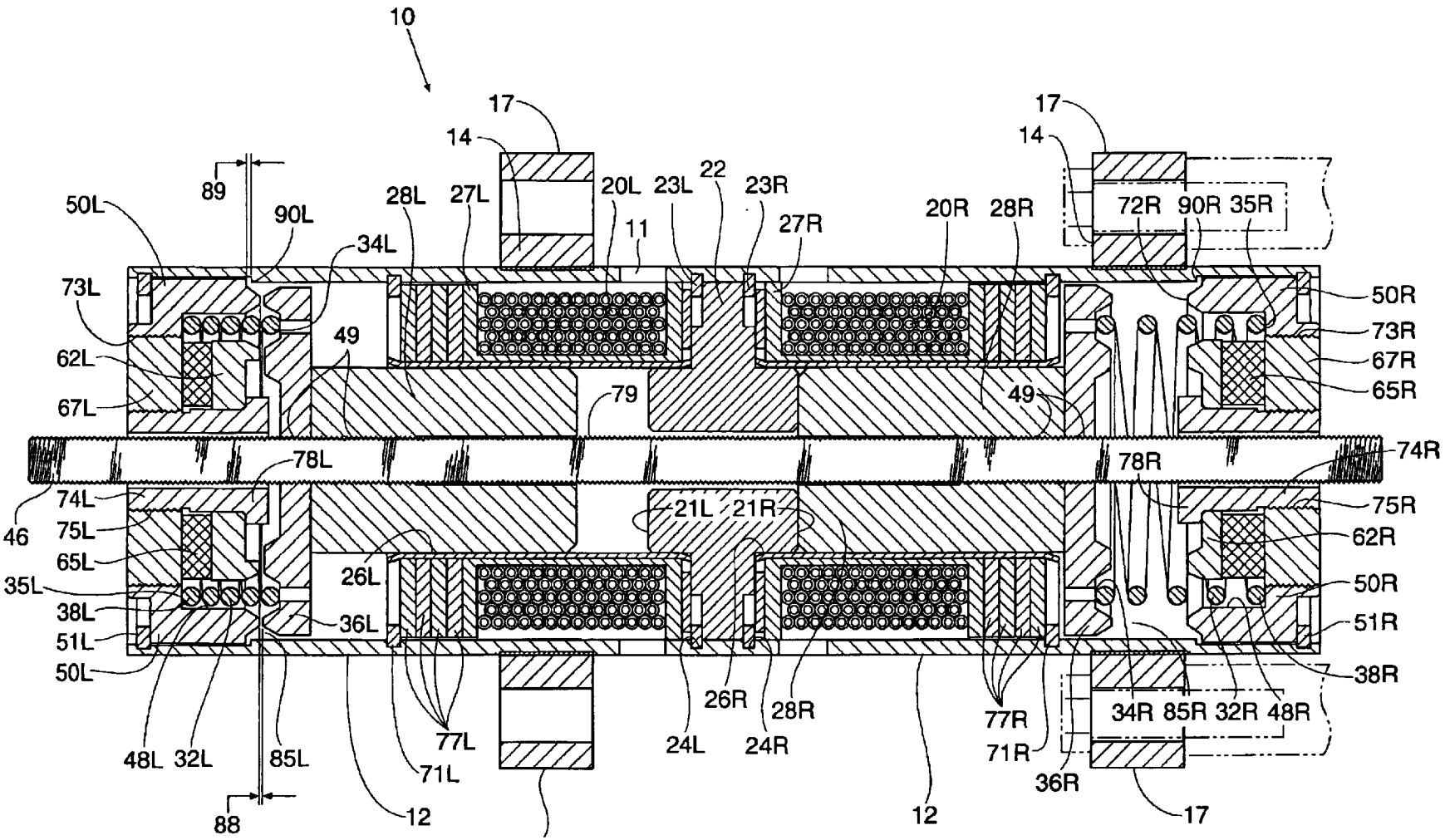
FIG. 1 is a longitudinal sectional view, taken along lines 1—1 of FIG. 2, of a bi-directional latching solenoid made in accordance with the teachings of the present invention.

Like parts illustrated and described herein are designated by like reference characters.

Referring to the drawings, and particularly to FIG. 1, there is illustrated a bi-directional version of the magnetic actuator device, or solenoid 10, of the present invention.

Figure 2:
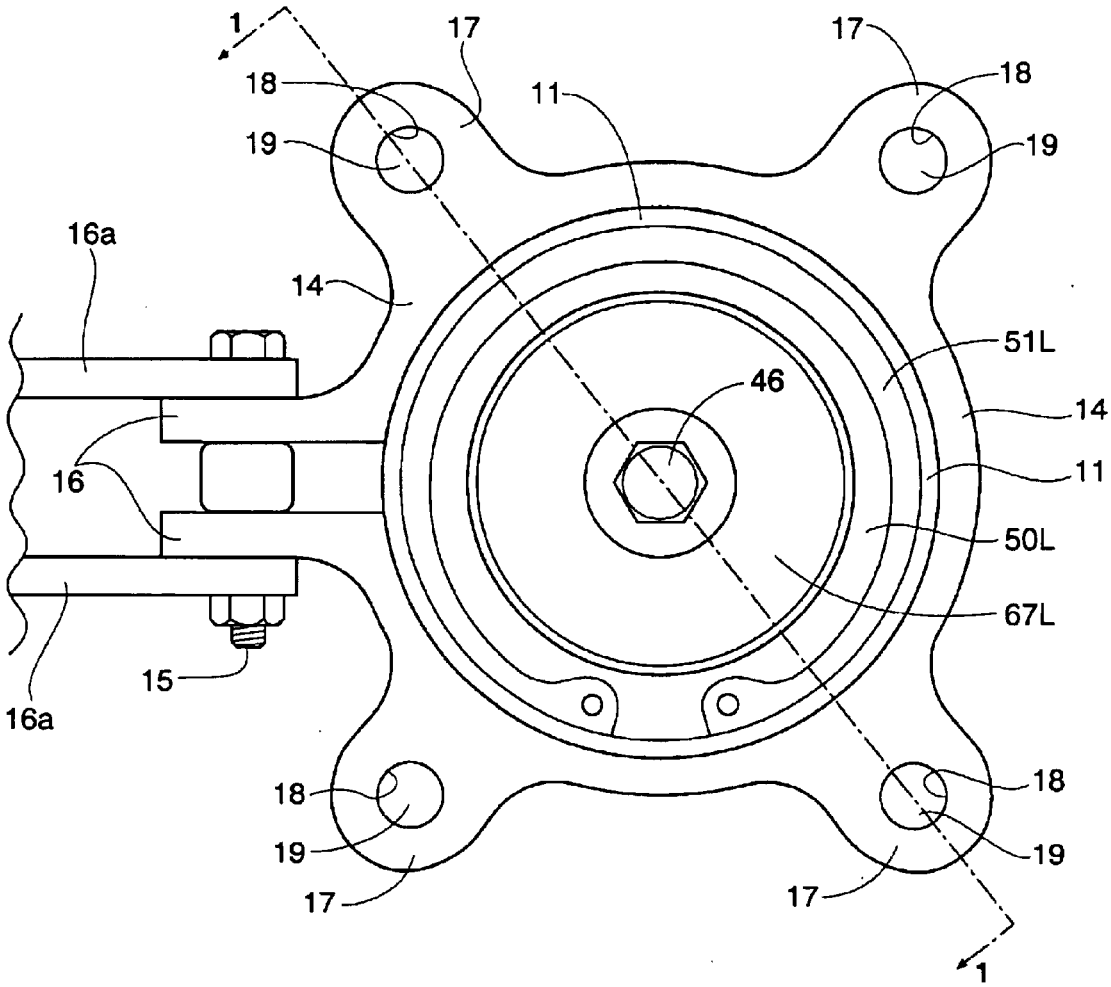
FIG. 2 is an end plan view of the bi-directional latching solenoid of FIG. 1, and including a surrounding mounting support for the solenoid assembly.

The bi-directional latching solenoid 10 preferably comprises a magnetic steel, tubular housing member 11. The housing 11 may be mounted to a vacuum bottle interrupter, or the like, by means of mounting clamps 14 shown in further detail in FIG. 2. The clamps 14 may be fastened in place by means of a bolt and nut fastener 15 inserted in aligned apertures (not shown) of laterally extending, oppositely disposed, bifurcated tang members 16. The tang members 16 are mounted for lateral support by extending cantilever plates 16*a*. Additional structural support may be obtained from a plurality (four, in this case) of radially extending apertured ears 17. The apertures 18 in each of the ears 17 are provided to receive elongated supporting rods 19. The rods 19 are each positioned in radially spaced, coaxial alignment with the tubular housing 11 to provide longitudinal support for substantially the entire length of the magnetic actuator device 10. The preferably circular inner clamping surface 12 of the respective clamps 14 ensures avoidance of ovality of the desired circular grooved outer surface of the tubular housing 11.

In the case of the presently described bi-directional solenoid apparatus 10, it is preferred to provide individually operated, longitudinally spaced solenoid coil assemblies 20L and 20R. The coil assemblies 20L, 20R are respectively positioned and supported at opposite sides 21L, 21R of a centrally located stationary magnetic pole piece 22. The pole piece 22 is secured in place by means of conventional retaining snap rings 23L and 23R located at the under-cut shoulder portions 24L and 24R located at opposite sides of the pole piece 22. Oppositely disposed non-magnetic tubular bobbins, or coil-supporting sleeves 27L and 27R are each further provided within through-bore 26L, 26R for slidably receiving and supporting respective armatures, or plungers 28L and 28R.

It will be noted that like parts are denoted in the drawings with like reference numerals, but with the additional indicia of "L" or "R" to indicate respective left and right locations as viewed with respect to he view of FIG. 1. Accordingly, the cooperating components of the respective latching mechanisms are associated with the movement of the armature 28L responsive to current flowing through the coil 20L, and likewise with the cooperating components associated with the armature 28R and its operating coil 20R. The operations of the components of the respective latching mechanisms are the same, except for alternative direction of longitudinal movement of the armatures, or plungers 28L and 28R under the influence of their respective coils 20L or 20R. The solenoid coils 20L and 20R are preferably wound on non-magnetic, tubular bobbins 27L and 27R, respectively. In order to ensure positive alternative linear movement of the plungers 28L, 28R, the operating rod 46 and the clapper members 36L, 36R are each preferably threadingly (see threads 49) and adhesively (LOCTITE® 680) secured to the push/pull operating rod 46, and are further arranged to alternatively move the rod 46 in response to the electromagnetic action of the respective solenoid coils 20L and 20R. The rod 46 is preferably threaded end-to-end to provide additional stability along its length.

As further illustrated in the view of FIG. 1, the dual action, or bi-directional, solenoid structure 10 includes the aforementioned coils 20L and 20R, respectively wound to provide respective alternative, bi-directional, linear motion to magnetic plungers, or armatures, 28L and 28R. The common stationary pole piece 22 allows the two axially spaced solenoid assemblies to operate magnetically independently, and thereby materially reduce magnetic leakage around the opposite ends to an insignificant level. The respective armatures or plungers 28L and 28R are arranged so that at the end of their respective strokes, they will abut the respective sides 21L and 21R of the stationary pole piece 22 under the influence of a respective electromagnetic coil 20L or 20R. The axially spaced, plungers 28L and 28R are each preferably threadingly (see threads 49) and adhesively (LOCTITE® 680) secured to the push/pull operating rod 46, and are further arranged to alternatively move the rod 46 in response to the electromagnetic action of the respective solenoid coils 20L and 20R.

As will hereinafter be discussed, the spring 32L is "lighter" than the "heavier" spring 32R. That is, the spring 32R for this particular solenoid configuration is preferably wound from 0.135" stainless steel type 302 wire with 2.94 active coils, and the lighter spring 32L is preferably wound from 0.095" stainless steel type 302 wire with 2.99 coils providing a spring rate of 3.33 pounds per inch. The heavy spring 32R provides a spring rate of 22.01 pounds per inch.

The inner volutes 34L and 34R of the springs 32L, 32R, respectively, rest against the inwardly facing recessed surfaces 35L and 35R of magnetic coupling members, exemplified herein by the plunger clapper members 36L and 36R.

It will be observed, as viewed in FIG. 1, that the bi-directional solenoid 10 includes independently left and right operable, magnetically latching mechanisms, which are located at opposite ends of the tubular housing 11. The axial spacing is insured by means of c-shaped snap rings 71L and 71R ended by conventional, magnetic flux washers 77L and 77R. The tubular bobbins 27L and 27R complete the physical assembly. Again, directing attention to FIG. 1, it will be observed that the left-hand magnetic latching assembly is axially spaced from the solenoid assembly comprising the coil 20L wound on the bobbin 27L, and its respective armature or plunger 28L. The right-hand magnetic latching assembly is also axially spaced from the solenoid assembly comprising the coil 20R wound on the tubular bobbin 27R and its respective armature or plunger 26R and located at the right of the snap ring 71R.

The outer volutes 38L and 38R of the respective biasing coil springs 32L and 32R are seated within inwardly facing re-entrant counter bores 48L and 48R formed on the inwardly facing surfaces of outer magnet holders SOL and 50R. The outer magnet holders 50L and 50R are restrained from outward longitudinal movement with respect to the tubular housing 11 by means of conventional snap rings 51L and 51R located at opposite ends of the housing 11. However, it is preferred to provide a narrow mechanical gap 89 between the respective outer magnetic holders 50L and 50R and the shoulders 90L and 90R. Thus, the gap 89 will permit enough axial "play" during the impacting motion of a respective plunger 28L, 28R. As will be later discussed, magnetic gap 88 will be narrowed to almost zero for optimal magnetic latching attraction of the mating components.

Operation of the device will next be described in connection with the view of FIG. 1, and assuming the left side of the device 10 is shown in the left side latched position. Upon energizing the coil 20L, the solenoid force builds until it overpowers the force created by the latched magnets 65L and the magnetic coupling member, or clapper 36L. It does not drive the flux of the magnets as is done in many prior art devices. The plunger or armature 28L will be rapidly accelerated towards the pole piece 22. Meanwhile, during the motion of the plunger 28R, and just before impact, the bias spring 32R will act to momentarily keep the sensitive magnet structure, including the respective magnet discs 65R, out of the way, i.e. being isolated from direct contact with members that will be impacted, until such time after the plunger 28L impacts upon the side 21L of the pole piece 22. At this time, the magnets 65R which are of sufficient strength to overcome the bias of the spring 32R, and the magnetic reluctance of the air gap 88, and will pull themselves up to the plunger clapper 36R to a latched condition. The like components are illustrated in latched position at the left side of the housing 11. The relationship of the cooperation components will complete a virtually closed magnetic circuit. The disclosed and preferred magnetic coupling of cooperating magnetic components provides a relatively large magnetic force. The forces build up to the large magnetic forces exerted by the selected permanent magnetic discs 65R and the almost zero air gap 88 resulting from the very tight tolerances of mating components of the preferred configuration. The average velocity of test devices has been found to be about one (1) meter per second. Obviously, because of using substantially identical components and characteristics, similar results are obtained from the operating action of coil 20R upon its armature, or plunger 28R, but in the opposite direction. The actual speed depends on the load curves of the device being actuated.

It is also within the province of this invention to extend the concept of the biasing means to include the concept of entrapping and compressing air within sealed chambers 85L and 85R created between the outer magnetic holders SOL and SOR and their respective clapper members 36L and 36R.

It will be apparent that the left-side armature 28L continues in motion until seating adjacent the pole piece 22 as shown in FIG. 1. Again, with reference to FIG. 1, during the alternative directional motion to the left, the opposite magnet assembly pulls toward and latches on to its plunger clapper or magnetic coupling member 36L, while overpowering the bias of the biasing spring 32L, which had kept the magnet assembly out of the way during the impact caused by the plunger seating motion. The high latching forces are obtained by optimizing the surface areas of the mating components. The surface areas are designed to cause the highest magnetic flux densities through the completed magnetic circuit.

Figure 3:
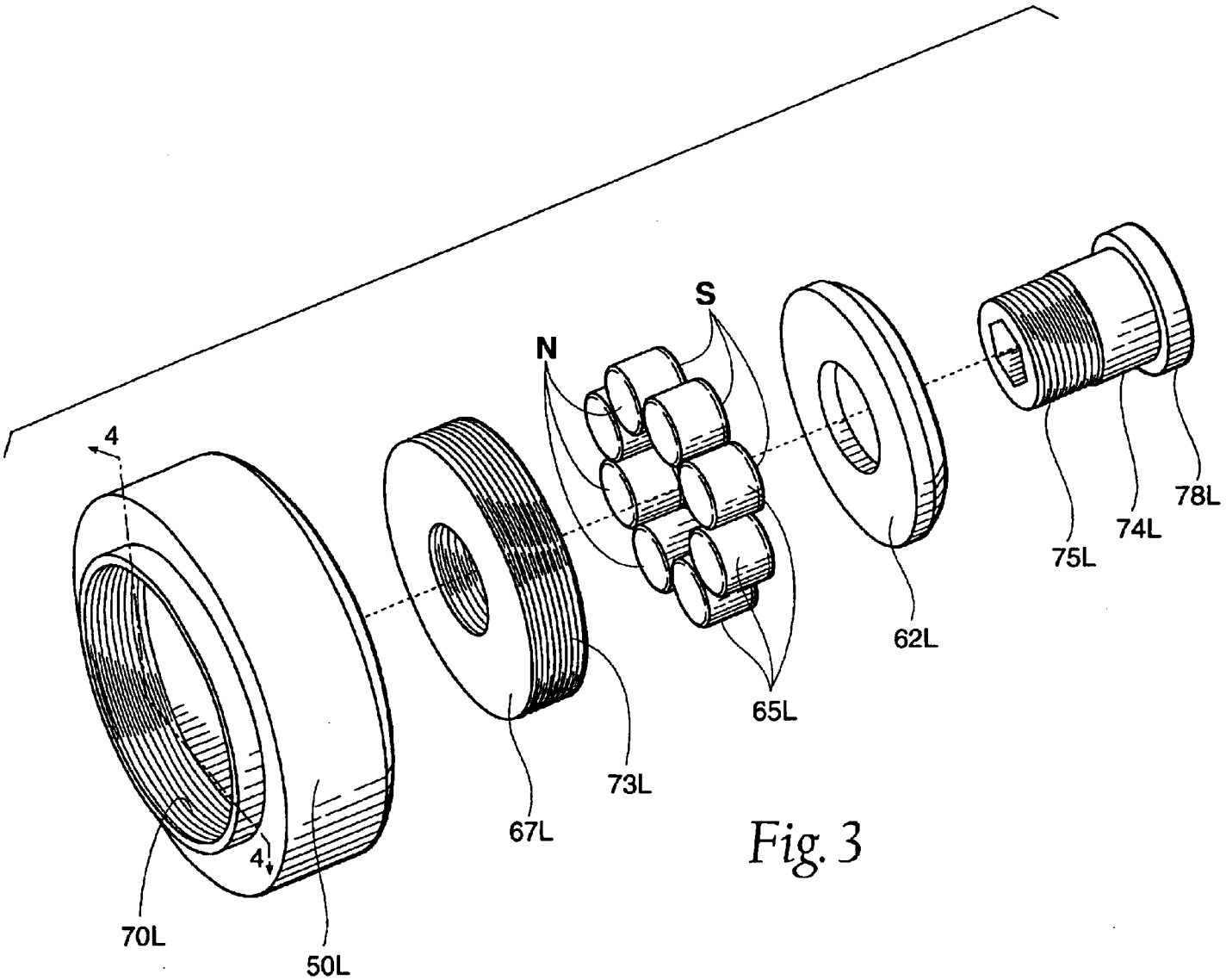
FIG. 3 is an exploded, perspective view of a permanent magnet latching subassembly, and in particular, a subassembly illustrating the components arranged for cooperation with a respective solenoid armature and ultimately act to magnetically latch the armature and solenoid push/pull rod in a desired operating position and in accordance with the teachings of this invention.
Figure 4:
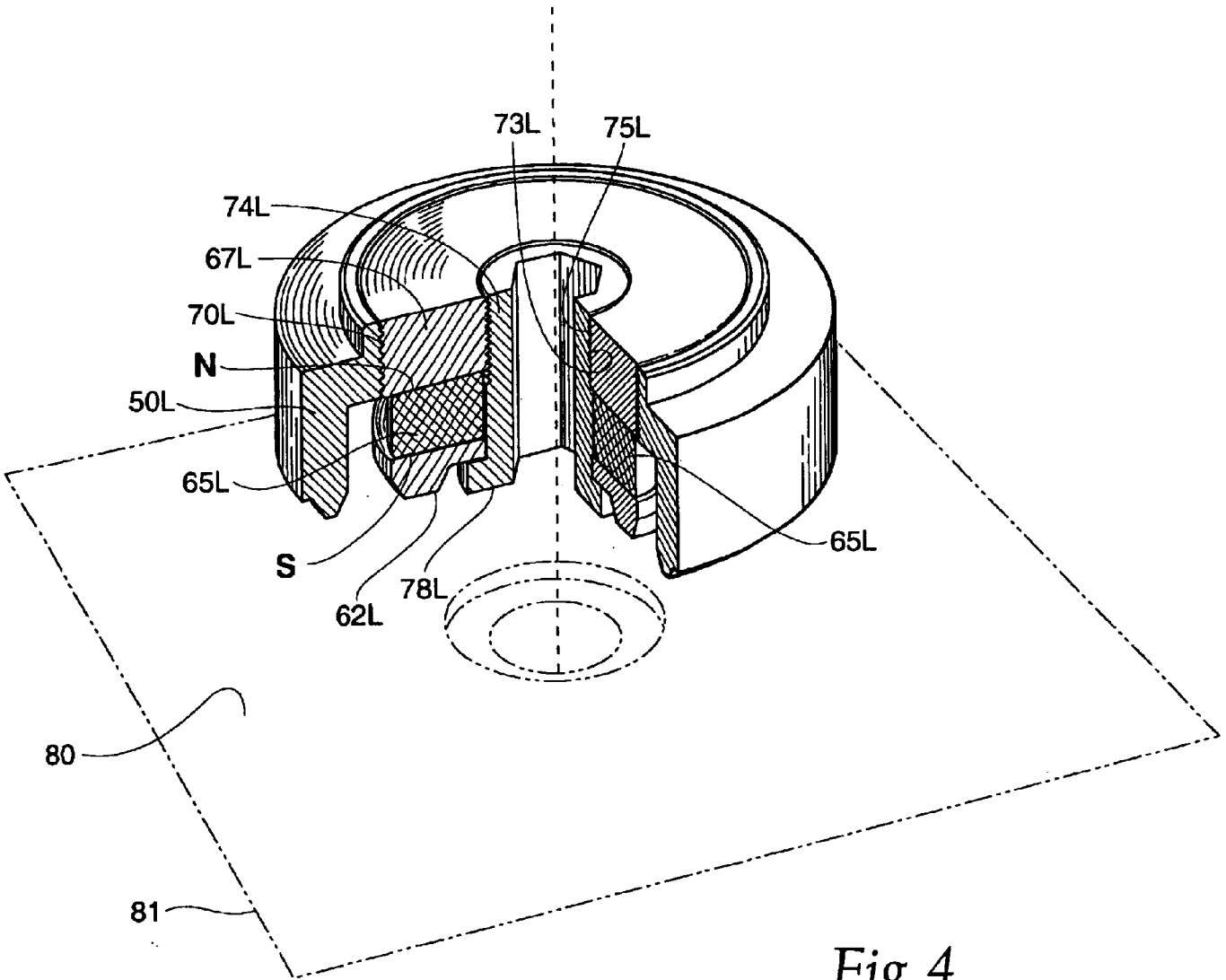
FIG. 4 is a perspective view of the latching subassembly of FIG. 3 and illustrating the components of the assembly in operating position relative to one another and with respect to a precision ground planar aligning surface shown in phantom view.

With further reference to the views of FIGS. 3 and 4, it will be observed that the components of each of the independent magnetic latching mechanisms are preferably pre-assembled as an integral unit, as shown herein with the left-hand indicia "L". The integral units respectively comprise inner magnet holder 62L, 62R each of magnetic material arranged for inner surface support of a pre-selected number of magnetic discs 65L, 65R, respectively. The outer surface of each of the magnetic discs 65L, 65R, are further retained by means of a middle magnet holder 67L, 67R. The magnet subassembly is held together by means of the threaded bore 70L, 70R, of an outer magnet holder 50L, SOR and the mating external threads 73L, 73R of the respective middle magnet holder 67L, 67R. The threaded areas are also coated with an adhesive such as LOCTITE® 680, and the entire assembly is held in compression by means of a non-magnetic threaded bolt 74L, 74R, the threads of which engage the threads 75L, 75R of the bore of the middle magnet holder 67L, 67R, in addition to a coating of an adhesive such as LOCTITE® 680. The flanged head 78L of the bolt 74L rests against the underside of the inner magnet holder 62L to complete the subassembly. With reference to FIG. 4, it will be noted that during assembly of the various cooperating parts, the parts are maintained in precise alignment by means of resting the inner surfaces 72L, 72R of the outer magnet holder 50L, 50R, and the innermost holder 62L, 62R on the precision ground surface 80 of a conventional fixturing jig 81 (shown here in phantom) While this is the preferred means for holding the magnet subassembly together, it is to be understood and appreciated that the subassembly could be held together utilizing an adhesive, a press-fit arrangement, an insert mold process or any other suitable means.

The magnetic discs 65L, 65R are preferably of a rare earth material exhibiting high magnetic energy per unit volume. A very satisfactory magnetic disc material may be formed and fired from a commercially available material identified as "RMND114 GRADE 30 ROCHESTER". Since magnetic discs 65L and 65R made from this material, like all rare earth magnetic materials, are relatively fragile, the operating elements of the present invention protects them against relatively rough and abrupt operation of the alternative motion of the armatures or plungers 28L, 28R. In particular, the present concept provides a means of isolating the magnets from the shock of impact of the respective plunger 28L, 28R at the end of travel and abutment against a respective surface 21L or 21R of the stationary pole piece 22.

It is also to be observed that each of the magnetic discs 65L, 65R have the same magnetic orientation. That is, each of their respective North and South poles face in the same direction. With this arrangement, the overall magnetic attraction will be enhanced. And also of importance, the magnets will be physically oriented with their respective North and South poles each facing the same direction. Assembly will require preventing the repulsion of adjacent magnets.

With reference to FIG. 1, it will be noted that in the present case, the axial lengths of the respective magnetic discs 65L are deliberately pre-selected to be less than the respective axial lengths of the discs 65R. The total axial lengths of the respective discs 65L combined with the axial length of the inner most holder 62L is identical with the total combined axial lengths of discs 65R and their respective innermost magnet holder 62R. Thus, dimensions of the various magnetic latching components may be varied to provide the respective dimensional gaps 88 of the left hand and right hand magnetic latching subassemblies.

In the disclosed preferred embodiment of the dual latching solenoid assembly 10, which may operate a conventional vacuum bottle circuit breaker, it has been determined that a satisfactory magnetic structure may utilize an ¾ magnetic construction. That is, the right-hand latching magnet assembly preferably comprises eight (8) magnetic discs 65R, along with the aforementioned heavier biasing spring 32R, whereas four (4) magnetic discs 65L utilize the combination of the four (4) discs 65L with the lighter biasing spring 32L.

The preferred design allows the use of multiple, low-cost, readily available magnets 65L and 65R, instead of a single conventional, high-cost, custom-made, toroidal magnets. A single, or even stacked toroidal magnet, do not provide the cost effectiveness achieved by the arrangement of individually magnetic discs 65L, 65R, which are preferred in the assembly exemplified by the views of FIG. 3 and FIG. 4.

It will be further apparent that the present invention includes three movable structures assembled in one housing, one of which has linkage to the workload. The latching structures are magnetically independent of the solenoid structures, and each solenoid is magnetically independent of the other solenoid. Also, the latching structures are not affected by the impacting of the solenoid structures. The biasing means, in the form of springs 32L and 32R keep the latching structure out of the way until the impact of the respective plunger with its side of stationary pole piece 22 has occurred. After the pull force of the latching structure, even with a relatively large air gap, is strong enough to compress the respective bias spring 32L or 32R, and to finally seat on the plunger coupling member, or clapper 36L or 36R. Once seated, the resulting air gap 88 is almost zero, and high latching force can thus be obtained. In addition, high actuation speed is possible, since no solenoid motion begins until the solenoid force exceeds the latching structure force.

The design further allows the use of multiple, low cost, readily available magnets 65L or 65R, instead of one high-cost custom magnet.

It will be observed that the construction of the latching assembly substantially cancels out the "stack up" of machining tolerances, thus making the device cost effective.

It will be further observed that the bi-directional magnetic latching solenoid 10 illustrated and described herein will provide a convenient and facily assembled and operated dual unit. It will be apparent that the unit may utilize substantially identical magnetic latching components for a single directionally operated solenoid by simply utilizing the respective latching components of either the right hand or the left hand component assemblies of the view of FIG. 1.

It will also be apparent that the herein disclosed configuration of the latching solenoid construction may further contemplate a magnetic configuration, or arrangement, which includes a polar array of two or more equally spaced disc magnets, two or more magnetic arcuate sections, or a single toroidal magnet of pre-selected magnetic strength.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A magnetically latched solenoid assembly comprising:

a housing, said housing supporting;

a solenoid subassembly and a magnetically latching subassembly laterally spaced from said solenoid subassembly, said solenoid subassembly comprising;

an electromagnetic coil, a tubular mandrel supporting said coil and including a through-bore, a moveable armature having at least a portion thereof supported by and longitudinally moveable within said mandrel through-bore and being responsive to electrical energization of said coil;

a stationary magnetic pole piece located proximate to one end of said mandrel through-bore;

an operating member secured to and arranged for concurrent movement of said armature;

said magnetic latching subassembly comprising;

a magnet holder slidably received by said housing, a magnetic coupling member secured to said operating member and arranged for minimal air gap magnetic latching engagement with said magnet holder upon longitudinal movement of said armature and said operating member;

said magnetic latching subassembly further comprising;

at least one permanent magnet; and biasing means arranged to momentarily prevent impact movement of said coupling member relative to said permanent magnet subassembly resulting from abutting engagement between said movable armature and said stationary pole piece, and for such time that magnetic attraction between said stationary magnet subassembly and said coupling member has reached sufficient force to overcome the bias of said biasing member and the magnetic reluctance of said minimal air gap.

2. A bi-directional solenoid comprising a tubular housing, said housing including;

first and second axially spaced solenoid assemblies supported by said housing, said solenoid assemblies each comprising an electromagnetic coil and coil supporting mandrel, each of said mandrels containing a through-bore, and a magnetic armature slidably received by a respective mandrel through-bore, and a reciprocally moveable operating member secured to each of said armatures and alternatively axially moveable upon movement of a respective armature responsive to electrical energization of a respective one of said coils;

a stationary magnetic pole piece located intermediate said solenoid subassemblies, and a first and a second magnetic latching subassembly, each of said magnetic latching subassemblies being respectively longitudinally spaced from said first and said second solenoid subassemblies;

each of said magnetic latching subassemblies comprising;

a longitudinally moveable permanent magnet subassembly containing at least one permanent magnet, a magnetic coupling member arranged for minimal air gap magnetic latching engagement with said longitudinally moveable permanent magnet subassembly upon longitudinal movement of said armature, and biasing means arranged to momentarily prevent impact movement of said coupling member relative to said permanent magnet-subassembly resulting from abutting engagement between said moveable armature and said stationary pole piece, and for such time that magnetic attraction between said longitudinally moveable permanent magnet subassembly and said coupling member has reached sufficient force to overcome the bias of said biasing member and the magnetic reluctance of said minimal air gap.

3. A magnetic latching solenoid comprising a housing, said housing containing:

a solenoid assembly, said solenoid assembly including;

a wound electromagnetic coil, a stationary magnetic pole piece, a magnetic armature operated by said coil and movable in a direction towards said pole piece, and an operating rod secured to and movable with said magnetic armature; and a permanent magnetic latching assembly, said magnetic assembly including a permanent magnet latching circuit structure comprising a magnet holder and a permanent magnet secured to and supported by said magnet holder, a magnet coupling member mechanically secured to said solenoid armature and movable therewith and being arranged to magnetically mate with said magnetic latching circuit structure upon abutting contact of said armature with said stationary pole piece, and thereby establish a minimal air gap between said coupling member and said permanent magnet latching structure, and biasing means arranged to bias said coupling member in a direction away from mating contact with said permanent magnet latching structure, and whereby upon achieving abutting contact between said armature and said stationary pole piece, the permanent magnet attraction between said coupling member and said magnetic latching circuit structure is sufficient to overcome the biasing force exerted by said biasing means.

4. A magnetic latching solenoid comprising:

a housing, said housing containing;

a solenoid assembly, a stationary magnetic pole piece laterally spaced from said solenoid assembly and a magnetic latching assembly laterally spaced from said solenoid assembly and from said pole piece;

said solenoid assembly including;

a nonmagnetic tubular mandrel having bore and having a first and a second end, said first end terminating at and supported by said stationary magnetic pole piece;

a bobbin-wound coil positioned circumjacent to and supported by said nonmagnetic tube;

a magnetic armature plunger, said plunger being slidably received by the bore of said nonmagnetic tube, said armature plunger having one end normally abutting said magnetic pole piece; and an operating rod secured to said armature plunger and extending outwardly of said housing;

said magnetic latching assemblies including;

a magnet retaining subassembly, said subassembly comprising;

an outer magnet holder supported by said housing and including a through bore arranged to receive and secure a middle magnet holder, said middle magnet holder including a threaded bore and at least one inwardly facing cavity, at least one permanent magnet disc residing in said cavity, an inner magnet holder abutting said permanent magnet disc and including a through bore, and a threaded clamping screw seated within the bore of said inner magnet holder and threadingly engageable with the threaded bore of said outer magnet holder;

a helical coiled biasing spring having a longitudinal portion surrounding said middle magnet holder, said middle magnet holder and said longitudinal portion being seated within the recessed area of said outer magnet holder, and the remaining longitudinal portion of said biasing spring extending inwardly of said housing;

a magnetic coupling member including a reentrant recessed area arranged to receive the innermost coil of the remaining longitudinal portion of said biasing spring, said coupling member including a flat, inwardly facing surface arranged for abutting contact with the outwardly facing end surface of said armature plunger for cushioning movement of said coupling member against the bias of said coiled spring and with the outwardly facing surface of said coupling member being arranged for magnetic latching contact with the inwardly facing surface of said inner magnet holder, said magnetic coupling member, when in closed latching position relative to said inner magnet holder, providing a substantially zero air gap between said coupling member and said inwardly facing.

5. The magnetic latching solenoid of claim 4, wherein said biasing means comprises a coiled compression spring located between said magnetic coupling member and said permanent magnet latching structure.

6. The magnetic latching solenoid of claim 4, wherein said permanent magnet latching circuit structure comprises a magnet holder and an array of a plurality of equally spaced disc magnets.

7. A bi-directional dual magnetic latching solenoid comprising a housing, said housing containing:

a stationary magnetic pole piece;

a pair of solenoid assemblies, each of said solenoid assemblies being spaced from opposite sides of said stationary pole piece and each of said solenoid assemblies including;

a wound electromagnetic coil;

a pair of magnetic armatures, each armature of said pair of armatures being operated by a respective one of said coils and being alternatively movable in a direction towards said pole piece; and an operating rod secured to and alternatively movable with each of said magnetic armatures;

magnetic armature operated by a respective one of said coils and being movable in a direction towards said pole piece;

an operating rod secured to and alternatively movable with each of said magnetic armatures; and a magnetic coupling member mechanically secured to a respective one of said pair of said solenoid armatures and movable therewith, said coupling member being arranged to magnetically mate with said magnetic latching circuit structure upon abutting contact of a respective one of said pair of armatures with said stationary pole piece, and thereby establishing minimal air gap between said coupling member and said permanent latching circuit structure; and biasing means arranged to bias a respective one of said coupling members in a direction away from mating contact with its respective permanent magnet latching structure, and whereby upon achieving abutting contact between a respective one of said armatures and the side of said stationary pole piece, the permanent magnet attraction between said coupling member and its respective magnetic latching circuit structure is sufficient to overcome the biasing force exerted by said biasing means.

8. A magnetic latching solenoid comprising:

a housing, said housing containing;

a solenoid assembly, a stationary magnetic pole piece axially spaced from said solenoid assembly, and a magnetic latching assembly axially spaced from said solenoid assembly and from said pole piece;

said solenoid assembly including;

a nonmagnetic tubular mandrel having a bore and having a first and a second end, said first end terminating at and supported by said stationary magnetic pole piece;

an electromagnetic coil positioned circumjacent to and supported by said nonmagnetic tube;

a magnetic armature plunger, said plunger being slidably received by the bore of said nonmagnetic tube, said armature plunger having one end normally abutting said magnetic pole piece; and an operating rod secured to said armature plunger and extending outwardly of said housing;

a magnetic latching assembly including;

a magnet retaining subassembly, said subassembly comprising;

an outer magnet holder supported by said housing and including a through bore arranged to receive and secure a middle magnet holder, said middle magnet holder including a threaded bore and at least one inwardly facing cavity, at least one permanent magnet disc residing in said cavity, an inner magnet holder abutting said permanent magnet disc and including a through bore, and a threaded clamping screw seated within the bore of said inner magnet holder and threadingly engageable with the threaded bore of said outer magnet holder;

a helical coiled compression spring having a longitudinal portion surrounding said middle magnet holder, said middle magnet holder and said longitudinal portion being seated within the recessed area of said outer magnet holder, and the remaining longitudinal portion of said spring extending inwardly of said housing;

a magnetic clapper member including a reentrant recessed area arranged to receive the innermost coil of the remaining longitudinal portion of said spring, said clapper member including a flat, inwardly facing surface arranged for abutting contact with the outwardly facing end surface of said armature plunger for cushioning movement of said clapper member against the bias of said coiled spring and with the outwardly facing surface of said clapper member being arranged for magnetic latching contact with the inwardly facing surface of said inner magnet holder, said magnet clapper member, when in closed latching position relative to said inner magnet holder, providing a substantially zero air gap between said clapper member and said inwardly facing surface.

9. The magnetic latching solenoid of claim 4 wherein the at least one permanent magnet disc is of rare earth material.

10. A magnetic latching solenoid comprising:

a magnetic tubular housing containing a through bore, said housing including;

a solenoid assembly, a stationary magnetic pole piece spaced inwardly from said solenoid assembly and a magnetic latching assembly spaced outwardly relative to said solenoid assembly;

said solenoid assembly including;

a magnetic tubular mandrel having bore and extending coaxially relative to said housing bore and having a first and a second end, said first end terminating at and supported by said stationary magnetic pole piece;

a bobbin-wound coil positioned circumjacent to and supported by said non-magnetic tube;

a magnetic armature plunger having a through bore, said plunger being slidably received by the bore of said non-magnetic tube, said armature plunger having one end normally abutting said magnetic pole piece and having its opposite end lying substantially coplanar with the plane intersecting the second end of said non-magnetic tube, said plane being substantially normal to the longitudinal axis of said tubular housing; and an operating rod slidably received by the bore of said magnetic pole piece and being secured to said armature plunger;

said magnetic latching assembly including;

a permanent magnet retaining subassembly, said subassembly comprising;

a longitudinally inwardly moveable outer magnet holder slidably supported by said tubular housing and arranged to normally provide a pre-determined axial gap within said housing, sad outer magnet holder including a through bore arranged to receive and secure a middle magnet holder, said middle magnet holder including a threaded bore and at least one inwardly facing cavity, at least one permanent magnet disc residing in said cavity, an inner magnet holder abutting said permanent magnet disc and including a through bore, and a threaded clamping screw seated within the bore of said inner magnet holder and threadingly engageable with the threaded bore of said outer magnet holder;

a helical coiled compression spring having a longitudinal portion surrounding said middle magnet holder, said middle magnet holder and said longitudinal portion being seated within the recessed area of said outer magnet holder, and the remaining longitudinal portion of said compression spring extending inwardly of said housing;

a magnetic clapper member slidably received by the bore of said tubular housing and including a reentrant recessed area receiving the innermost coil of the remaining longitudinal portion of said biasing spring, said clapper member including a flat, inwardly facing surface arranged for abutting contact with the outwardly facing end surface of said armature plunger for biasing movement of said clapper member against the bias of said coiled spring, and with the outwardly facing surface of said clapper member arranged for magnetic latching contact with the inwardly facing surface of said inner magnet holder, said magnetic clapper member, when in closed latching position relative to said inner magnet holder, providing a substantially zero air gap between said clapper member and said inwardly facing surface of said inwardly moveable magnet holder.

11. The magnetic latching solenoid of claim 6 wherein at least one permanent magnet disc is of rare earth material.

* * * * *